US009107801B2

(12) United States Patent
Knight

(10) Patent No.: US 9,107,801 B2
(45) Date of Patent: Aug. 18, 2015

(54) PELVIC SUPPORT THERAPY DEVICE AND METHOD OF USE THEREOF

(71) Applicant: Jennifer E. Knight, Clio, MI (US)

(72) Inventor: Jennifer E. Knight, Clio, MI (US)

(73) Assignee: Covenant Medical Center, Inc., Saginaw, MI (US)

( * ) Notice: Subject to any disclaimer, the term of this patent is extended or adjusted under 35 U.S.C. 154(b) by 246 days.

(21) Appl. No.: 13/833,141

(22) Filed: Mar. 15, 2013

(65) Prior Publication Data

US 2014/0261448 A1 Sep. 18, 2014

(51) Int. Cl.

| | |
|---|---|
| ***A61G 15/00*** | (2006.01) |
| ***A61H 37/00*** | (2006.01) |
| ***A61G 13/00*** | (2006.01) |
| ***A61G 13/12*** | (2006.01) |
| *A61H 1/02* | (2006.01) |

(52) U.S. Cl.

CPC ..... *A61H 37/00* (2013.01); *A61G 13/009* (2013.01); *A61G 13/123* (2013.01); *A61G 13/129* (2013.01); *A61G 13/1245* (2013.01); *A61G 15/005* (2013.01); *A61G 2200/12* (2013.01); *A61H 1/0244* (2013.01); *A61H 2201/0192* (2013.01); *A61H 2201/164* (2013.01)

(58) Field of Classification Search

CPC . A61G 7/015; A61G 13/0009; A61G 1/0218; A61G 1/0237; A61G 1/0268; A61G 1/0275; A61G 1/0281; A61G 1/04; A61G 2001/042; A61G 2005/1051; A61G 2005/125; A61G 2007/0509; A61G 2007/0528

USPC ..... 128/845, 882; 602/23, 28, 60, 62

See application file for complete search history.

(56) References Cited

U.S. PATENT DOCUMENTS

| | | | | |
|---|---|---|---|---|
| 1,635,638 | A * | 7/1927 | Rogers | 128/882 |
| 1,845,338 | A * | 2/1932 | Querna | 128/882 |
| 2,978,713 | A * | 4/1961 | Scalzitti et al. | 5/648 |
| 3,505,994 | A | 4/1970 | Smith, Jr. | |
| 3,532,336 | A | 10/1970 | Baker | |
| 3,892,231 | A * | 7/1975 | Tummillo | 602/24 |
| 3,946,451 | A | 3/1976 | Spann | |
| 4,135,504 | A | 1/1979 | Spann | |
| RE30,444 | E | 12/1980 | Spann | |
| 4,327,714 | A | 5/1982 | Spann | |
| 5,148,800 | A * | 9/1992 | Pecheux | 601/29 |
| D345,797 | S | 4/1994 | Gardner | |
| D359,190 | S | 6/1995 | Hargest et al. | |
| 5,479,471 | A * | 12/1995 | Buckland | 378/208 |
| 5,499,958 | A * | 3/1996 | Hess | 482/79 |
| D383,637 | S | 9/1997 | Musco | |
| D386,643 | S | 11/1997 | Farrell | |
| 5,908,397 | A * | 6/1999 | Tatum et al. | 602/5 |
| 6,553,995 | B1 | 4/2003 | Cole et al. | |
| 6,634,045 | B1 | 10/2003 | DuDonis et al. | |
| 6,725,481 | B1 | 4/2004 | Marshall | |
| D521,301 | S | 5/2006 | Dickson | |
| 7,036,169 | B2 | 5/2006 | Marshall | |
| D625,421 | S | 10/2010 | Sharps et al. | |
| D642,694 | S | 8/2011 | Sharps et al. | |
| 2012/0180219 | A1 | 7/2012 | Riccabona | |

* cited by examiner

*Primary Examiner* — Michael Brown

(74) *Attorney, Agent, or Firm* — John D. Wright; Dickinson Wright PLLC

(57) ABSTRACT

A pelvic therapy support device and method of supporting a patient's legs therewith while performing pelvic support therapy are provided. The device includes a center support, a support member coupled to the center support, and a pair of leg supports carried by the support member. Each of the leg supports is disposed on an opposite side of the center support. The leg supports are moveable independently from one another toward and away from the center support.

14 Claims, 3 Drawing Sheets

PELVIC SUPPORT THERAPY DEVICE AND METHOD OF USE THEREOF

BACKGROUND OF THE INVENTION

1. Technical Field

This invention relates generally to therapy support devices, and more particularly to pelvic therapy support devices.

2. Related Art

Women's health, pelvic support therapy has increased drastically over the past 10 years. Physical therapy has been found to greatly increase the rate of recovery from many symptoms of pelvic floor dysfunction (PFD), including problems with urinary urgency, frequency, or hesitancy, stopping and starting, painful urination, or incomplete emptying, constipation, straining pain with bowel movements, unexplained pain in the lower back, pelvic region, genital area, or rectum, and pain during or after intercourse, for example. The therapy is performed to stretch and massage the pelvic floor. The pelvic floor is a group of muscles that attaches to the front, back, and sides of the pelvis and to the tailbone and sacrum. These muscles support the pelvic organs, including the bladder, uterus or prostate, and rectum, and wrap around the urethra, vagina, and rectum. Coordinated contraction and relaxation of these muscles helps control bladder and bowel function. In patients who have PFD, these muscles may be tight or in spasm, have a combination of tightness and weakness, or have pain-trigger in spots or knots called "trigger points." Pain brought on from organs, such as the bladder, may set off these muscle problems, but the muscle problems themselves can also set off bladder symptoms. Pain can also result in other muscles, such as in the lower abdomen, lower back, buttocks, thighs, and perineal area, or the pain can be sent from these areas back to the internal organs, contributing to symptoms.

Physical therapy to treat the aforementioned problems can go a long way toward easing the symptoms resulting therefrom. Some well-known physical therapy techniques are performed via external massage and internal pelvic floor massage, which helps relax and lengthen tight pelvic floor muscles and release trigger points. The internal pelvic floor massage includes massaging within the vagina and/or rectum.

Although the various techniques of massage and stimulation, e.g. electrical stimulation, have been proven effective in treating PVD, the therapist and patient are often met with challenges while the therapy is being performed. From the standpoint of both the patient and physical therapist, comfort and fatigue can prove problematic. This results in in large part due to the lack of ability to support the patient in a comfortable position over the duration of the therapy. Further, problems arise for the therapist in that the arm of the therapist often becomes fatigued, also due to the inability to maintain the arm in a comfortable position over the duration of the therapy. Further complicating matters is the variety of patient shapes and sizes. With each patient, a slightly different configuration of support may be needed. Currently, it is common practice to use standard pillows to provide the support to both the patient's legs, while the physical therapist hold their arm in mid-air. Unfortunately, pillows come with several drawbacks, including, to name a few, an inability to reliably support the patient's legs in a comfortable position over the duration of the procedure, having to launder the pillows and/or pillow cases after each use, the tendency for the pillows to absorb contaminants and become stained, having the material within the pillows break-down over time, having to ensure sterility of the pillows prior to use, having the pillows fall from an examination table (plinth) during the procedure, having various, unpredictable firmness's of pillows contributing to unpredictable levels of comfort or discomfort, and having to replace pillows after they become insufficient for continued use.

SUMMARY OF THE INVENTION

In accordance with one aspect of the invention, a pelvic therapy support device is provided. The device includes a center support, a support member coupled to the center support, and a pair of leg supports carried by the support member. Each of the leg supports is disposed on an opposite side of the center support. The leg supports are moveable independently from one another toward and away from the center support.

In accordance with another aspect of the invention, the leg supports have a rigid support member, a compliant material and an impervious, sterilizable layer covering the compliant material.

In accordance with another aspect of the invention, the rigid support member is external to the compliant member.

In accordance with another aspect of the invention, the at least a portion of said rigid support member is encapsulated within the compliant member.

In accordance with another aspect of the invention, the support member has an upper support surface and the center support and the leg supports are supported on the upper support surface, wherein the leg support slide along the upper surface.

In accordance with another aspect of the invention, the upper support surface of the support member has one of ribs or grooves and the leg supports have the other of the ribs or grooves, wherein the ribs and grooves are configured to slide along one another.

In accordance with another aspect of the invention, the leg supports are generally saddle-shaped having a pair of upstanding sidewalls spaced from one another by an intermediate base.

In accordance with another aspect of the invention, the center support has an adjustable height feature.

In accordance with another aspect of the invention, a method of supporting a patient's legs while performing pelvic support therapy is provided. The method includes providing a unitized pelvic support device having a center support, a support member coupled to the center support, and a pair of leg supports carried by the support member for slidable movement toward and away from the center support. Further, adjusting the relative position of the leg supports relative to the center support. Then, disposing a portion of a patient's legs on the leg supports, and then performing pelvic support therapy.

In accordance with another aspect of the invention, the method further includes using the center support as an arm rest.

In accordance with another aspect of the invention, the method further includes adjusting the height of the center support.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
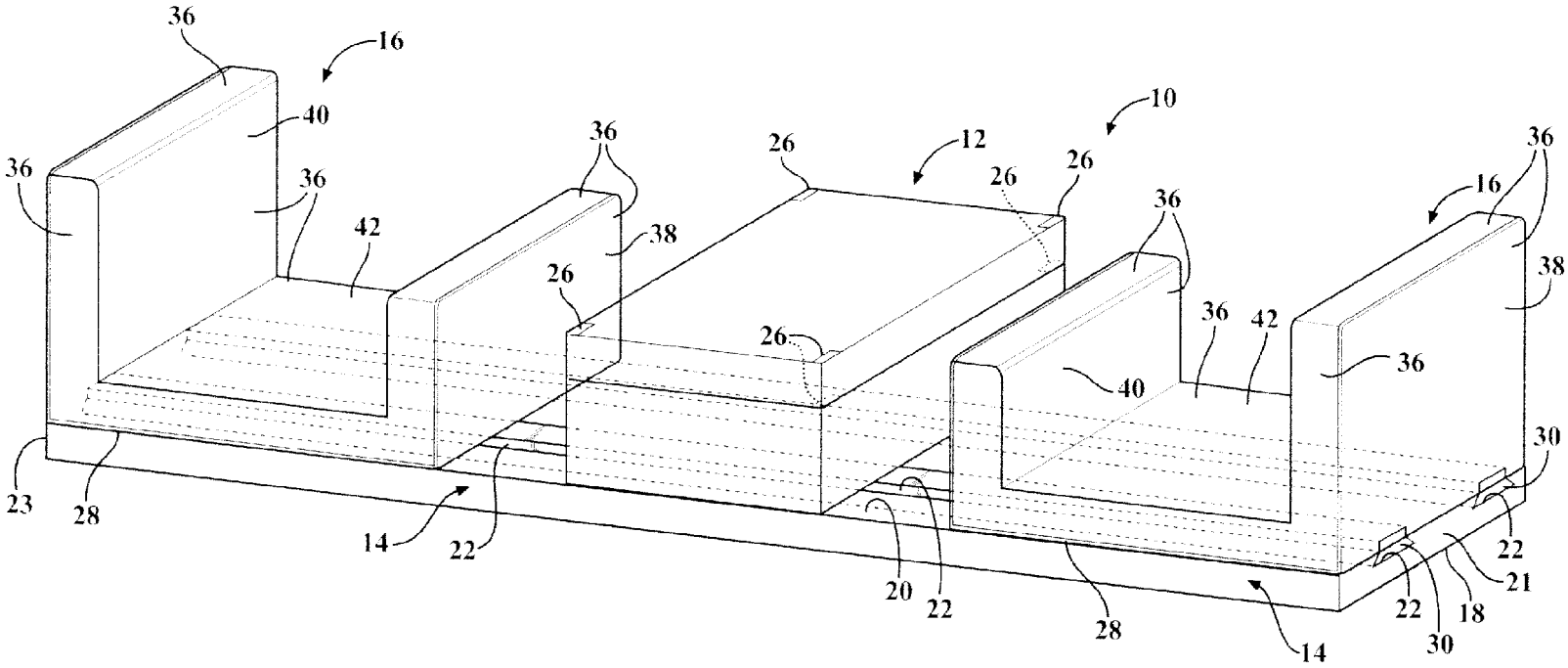
FIG. 1 is a perspective view of a pelvic therapy support device constructed in accordance with one aspect of the invention.
Figure 2:
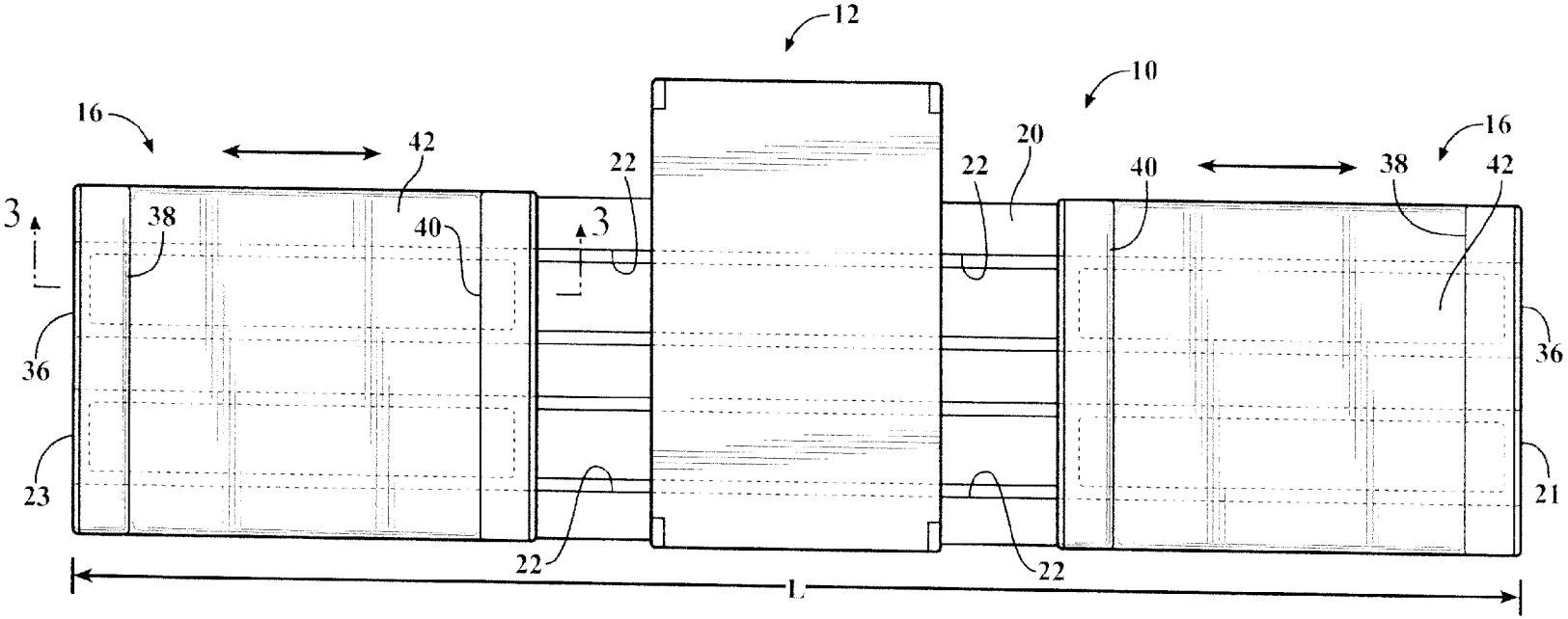
FIG. 2 is a plan view of the pelvic therapy support device of FIG. 1.

Referring in more detail to the drawings, FIG. 1 illustrates a pelvic therapy support device, referred to hereafter as device 10, constructed in accordance with one aspect of the invention. The device 10 facilitates performing physical therapy, and in particular, pelvic therapy. The device 10 includes a center support 12 and a base, also referred to as support member 14, coupled to the center support 12. Further, the device 10 includes a pair of leg supports 16 carried by the support member 14, with each of the leg supports 16 being disposed on opposite sides of the center support 12. To facilitate positioning the patient's legs during therapy, the leg supports 16 are moveable independently from one another toward and away from the center support 12 along the direction of the arrows 17.

The support member 14 is shown as a rigid planar member having a generally flat bottom surface 18 and a generally flat upper support surface 20. The support member 14 can be constructed from any suitable lightweight, rigid material, such as a rigid plastic, for example, with plastic being economical in construction, such as via molding. It should be recognized that other materials could be used if desired, such as metallic materials, or otherwise. The bottom surface 18 is sized having a length (L) extending between opposite ends 21, 23. The length L is such that the device 10 rests in stable fashion across a width of an upper surface of a standard examination table (not shown) without extending over the edges of the examination table. As such, the device 10 can be readily used without concern of slipping off the examination table or being otherwise cumbersome by extending beyond the edges of the examination table. The upper support surface 20 is sized to support the center support 12 and the leg supports 16 thereon. The upper support surface 20 has, by way of example and without limitation, one of ribs extending therefrom or grooves extending therein, and is shown, for example, as having a plurality of grooves 22 extending along the length of the upper support surface 20. The grooves 22 are shown as being generally trapezoidal in shape, by way of example. The grooves 22 facilitate the lateral movement of the leg supports 16 in use, though other mechanisms are contemplated herein, such as standard bearing slides, such as those used in drawers, and the like.

The center support 12 is centered along the support member 14 between the opposite ends 21, 23. The center support 12 can be fixed to the upper support surface 20, or otherwise releasable fixed thereto, thereby allowing the center support 12 to be selectively disassembled from the support member 14 after use, if desired. The center support 12 is intended to act as an arm rest to the therapist, thereby avoiding the therapist having to hold their arm in mid-air throughout a physical pelvic therapy session. To facilitate providing comfort, the main body of the center support 12 can be formed of a compliant material, such as any desired foam, rubber, or otherwise. Further, to facilitate providing a comfortable height at which the therapist can rest their arm, the center support 12 can be provided with one or a plurality of adjustable height features 24. The adjustable height feature 24 is an extension add-on feature composed of the same compliant material used to form the main body of the center support 12. The adjustable height feature 24 can be provided having any desired height, and is generally provide having the same envelope as the underlying center support 12. To ensure the adjustable height feature 24 stays in its intended location during use, one or more fasteners 26, such as hook and loop type fastener, by way of example and without limitation, can be applied to the mating surfaces of the center support 12 and the overlying adjustable height feature 24. It should be recognized that any number of adjustable height features 24, of similar or varying heights, can be stacked and reliably fixed to one another to achieve the desired height.

The leg supports 16 are configured for slidable movement along the upper support surface 20 toward and away from the center support 12. To facilitate sliding movement, the leg supports 16 have a bottom surface 28 with an opposite one of ribs extending therefrom or grooves extending therein from the support member 14, and are shown, by way of example and without limitation, as having a plurality of ribs 30 extending along or substantially the length of the bottom surface 28. The ribs 30 are shown as being generally trapezoidal in shape for close sliding receipt within the grooves 22 of the support member 14 to form a dovetail-type slide joint with the grooves 22.

Figure 3:
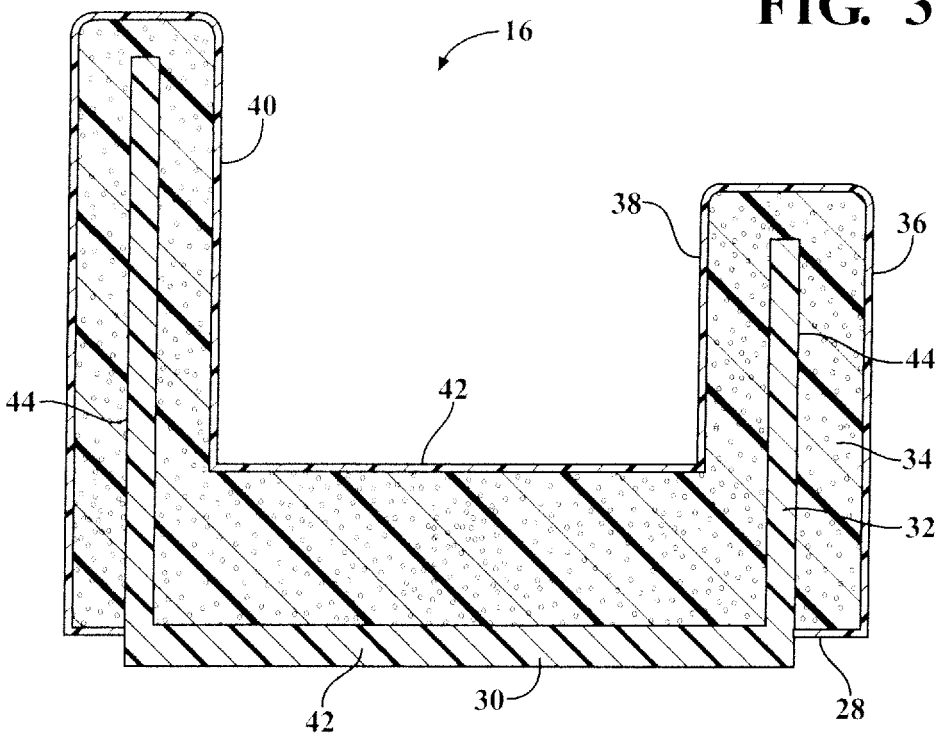
FIG. 3 is a cross-sectional view of a leg support taken generally along the line 3-3 of FIG. 2.
Figure 4:
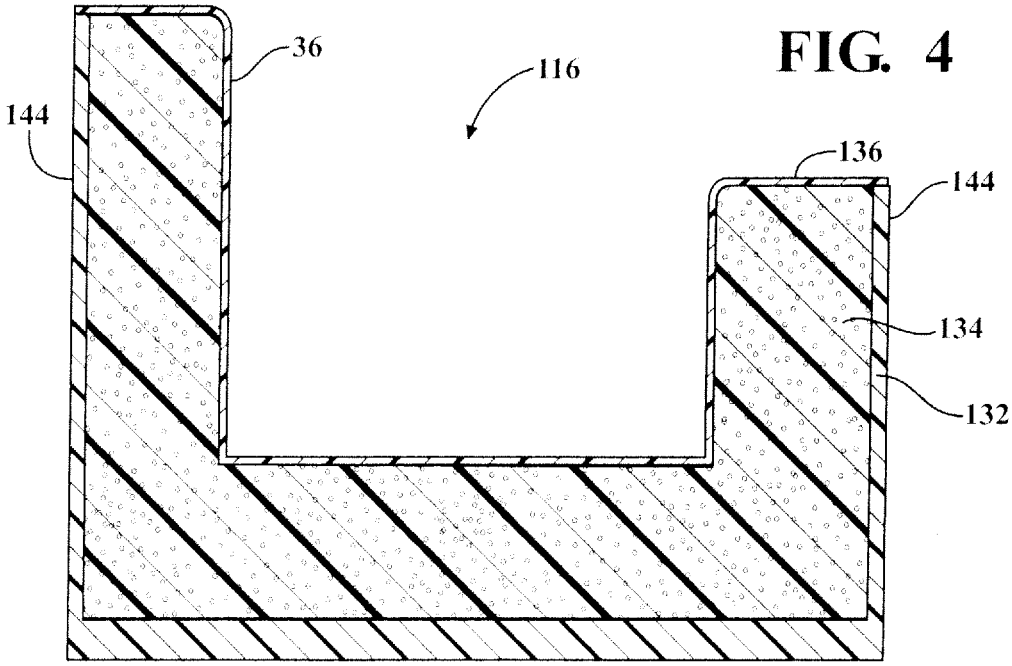
FIG. 4 is a cross-sectional view similar to FIG. 3 of a leg support constructed in accordance with another aspect of the invention.

As best shown in FIG. 3, the leg supports 16 have rigid support members 32 to maintain the form of the supports 16 in use, a compliant material 34 to provide comfort and an impervious, sterilizable outer layers 36 covering the compliant material 34 to allow the leg supports 16 to be readily sterilized after use, such as via a simple wiping with a hospital grade cleanser, for example, as is the entire device 10. The leg supports 16 are generally U-shaped or saddle-shaped in cross-section, having a pair of upstanding sidewalls 38, 40 spaced from one another by an intermediate base 42. The rigid support members 32 can be formed from any suitable plastic or metallic material, however plastic is more economical and lightweight. The compliant material can be provided as described above for the center support 12, and the sterilizable outer layers 36 can be provided from any suitable hospital grade impervious plastic film or sheet, such as polyvinyl, for example. The leg supports 16 are shown as having at least a portion of the rigid support members 32, shown as upstanding legs 44, encapsulated within the compliant material 34, with a base 46 being exposed along the bottom surface 28 and forming the ribs 30. Accordingly, the ribs 30 and the rigid support member 32 are formed as a single, monolithic piece of material. Otherwise, as shown in another embodiment in FIG. 4, wherein the same reference numerals, offset by a factor of 100, are used to identify like features, the rigid support members 132 of the leg supports 116 can remain external to the compliant material 134, wherein the upstanding legs 144 extend along outer sides of the compliant material. This requires less use of the impervious, sterilizable material of the outer layer 136, as the material of the rigid support members 132 is readily sterilizable.

It should be understood that many modifications and variations of the present invention are possible in light of the above teachings. Accordingly, it is to be understood that the invention may be practiced otherwise than as specifically described, and that the scope of the invention is defined by any ultimately allowed claims.

What is claimed is:

1. A pelvic therapy support device, comprising:

a center support;

a support member coupled to said center support;

a pair of leg supports carried by said support member, each of said pair of leg supports being disposed on opposite sides of said center support and being moveable independently from one another toward and away from said center support; and wherein said leg supports have a rigid support member, a compliant material and an impervious, sterilizable layer covering said compliant material.

2. The pelvic therapy support device of claim 1 wherein said rigid support member is external to said compliant material.

3. The pelvic therapy support device of claim 1 wherein at least a portion of said rigid support member is encapsulated within said compliant material.

4. The pelvic therapy support device of claim 1 wherein said support member has an upper support surface and said center support and said leg supports are supported on said upper support surface.

5. The pelvic therapy support device of claim 4 wherein said leg supports are configured for slidable movement along said upper support surface.

6. The pelvic therapy support device of claim 5 wherein said center support is fixed to said upper support surface.

7. The pelvic therapy support device of claim 6 wherein said upper support surface has one of ribs or grooves and said leg supports have the other of said ribs or grooves, said ribs and grooves being configured to slide along one another.

8. A pelvic therapy support device, comprising:

a center support;

a support member coupled to said center support;

a pair of leg supports carried by said support member, each of said pair of leg supports being disposed on opposite sides of said center support and being moveable independently from one another toward and away from said center support; and wherein said leg supports are generally saddle-shaped having a pair of upstanding sidewalls spaced from one another by an intermediate base.

9. The pelvic therapy support device of claim 8 wherein said leg supports have a rigid support member, a compliant material and an impervious, sterilizable outer layer, each extending along said sidewalls and said intermediate base.

10. A pelvic therapy support device, comprising:

a center support;

a support member coupled to said center support;

a pair of leg supports carried by said support member, each of said pair of leg supports being disposed on opposite sides of said center support and being moveable independently from one another toward and away from said center support; and wherein said center support has an adjustable height feature.

11. The pelvic therapy support device of claim 10 wherein said center support includes a plurality of members stackable in releasably fixed relation with one another to form said adjust height feature.

12. A method of supporting a patient's legs while performing pelvic support therapy, comprising:

providing a unitized pelvic support device having a center support, a support member coupled to the center support, and a pair of leg supports carried by the support member for slidable movement toward and away from the center support;

adjusting the relative position of the leg supports relative to the center support;

disposing a portion of a patient's legs on said leg supports; and massaging the patient's pelvic region.

13. The method of claim 12 further including using the center support as an arm rest for the therapist.

14. The method of claim 13 further including adjusting the height of the center support.

* * * * *